US005283733A

United States Patent [19]

Colley

[11] Patent Number: 5,283,733

[45] Date of Patent: Feb. 1, 1994

[54] COMPUTER ON-LINE GOLF SCORING DEVICE

[76] Inventor: Russell H. Colley, 2611 Ocean Dr., Vero Beach, Fla. 32963

[21] Appl. No.: 858,336

[22] Filed: Mar. 24, 1992

[51] Int. Cl.[5] ..... G06F 15/28; G06F 15/44; G06G 7/48

[52] U.S. Cl. ..... 364/411; 340/323 R; 273/32 R

[58] Field of Search ..... 364/410, 411; 340/323 R; 377/15; 273/32 R, 439, 181 H

[56] References Cited

U.S. PATENT DOCUMENTS

| | | | |
|---|---|---|---|
| 3,760,519 | 9/1973 | Niven | 235/114 |
| 4,266,214 | 5/1981 | Peters, Jr. | 340/323 R |
| 4,367,526 | 1/1983 | McGeary et al. | 377/5 |
| 4,437,672 | 3/1984 | Armantrout et al. | 273/185 B |
| 4,896,886 | 1/1990 | Colley | 273/184 |
| 4,910,677 | 3/1990 | Remedio et al. | 364/410 |
| 5,018,736 | 5/1991 | Pearson et al. | 273/439 |

*Primary Examiner*—Roy N. Envall, Jr.
*Assistant Examiner*—Laura Brutman
*Attorney, Agent, or Firm*—Alvin S. Blum

[57] ABSTRACT

A computer network extends around all the holes of a golf course including a series of interconnected display terminals that can display the real time scores of all players on the course at any time. They may also be equipped with printers for generating hard copies of scores. The terminals are provided with transceivers for two-way radio communication with transceivers in portable player's units carried by each of the players. Each player's unit is provided with a unique transmittable code signal that identifies the unit to the system. Before starting play, a player's identity and the code of the player's unit carried are registered in the system, as well as the team or foursome he is playing with. Before each stroke, a player actuates his unit, which sends a coded radio signal to the nearby terminal. The terminal identifies the player by the code, adds one stroke to his score, and transmits to all players on his team, through their player's units, an audible signal so that honest score keeping is insured. Audible or visible current scores may be transmitted to the player's units as well. To indicate to the computer network that play on a hole has been completed by a player, an electronic ball/cup sensor may be provided at each hole. Alternatively, the player at a terminal or via his player's unit may provide that signal before teeing off on the next hole.

13 Claims, 2 Drawing Sheets

COMPUTER ON-LINE GOLF SCORING DEVICE

BACKGROUND OF THE INVENTION

This invention relates to the game of golf and more particularly to a computer based score keeping system that operates on line as the game is in play.

Players generally keep their own scores when playing, and it is difficult for spectators and other players to know what the scores are for all the other players as the game is in progress. And players may not always record each stroke taken, either inadvertently or deliberately.

SUMMARY OF THE INVENTION

It is accordingly an object of the invention to provide a golf scoring system in which the golfer still keeps score personally but in which an electronic system records the strokes. It is another object that the system provide assurance to the other players that each player is faithfully recording each stroke. It is yet another object that the score of any player is kept current and is available to any spectator or other player by display or printing. It is yet another object that the sinking of a putt is not credited unless the putt is actually sunk.

The golf scoring system of the invention is provided by a system of electronic computer based scoring units, player's units and hole signalling units. A scoring unit is stationed at each hole. It has a receiver that receives information from the hole whenever a ball is received in the hole by means of a ball sensor by either wire or wireless communication. It also receives wireless communication from portable player's units.

Each player's unit has a transceiver that transmits signals to the scoring units. The signals include an identifying code that identifies a particular player's unit and/or a particular player. Before teeing off, each player actuates a hole signal that identifies the particular hole he is teeing off to as well as his identifying code. When the scoring unit for that particular hole receives a hole signal, it registers that player's unit for the hole and sends back an acknowledge signal which activates an audible signal when received by the now-registered player's unit. Before each stroke is played, the player must actuate his player's unit which transmits the player's identifying code to the scoring unit. If the player's unit is registered, it adds one stroke to the player's score and sends an acknowledge signal to all the registered player's units where an audible signal is sounded when the scoring unit's signal is received. All of the players then know that the player who is about to play has recorded his intended stroke.

Whenever a scoring unit receives a signal from a hole transmitter, it records total strokes for the player's unit from which it last received a signal designated for that hole and it will will not accept any more strokes from the unit for that hole. The score for that unit and/or player for that hole may then be displayed, printed, and communicated to a central unit. All of the scoring units may also be able to display/print the total score at any time.

In the simplest mode, each player's unit is numbered and arranged to always transmit a number code corresponding to that number whenever it sends a signal. And whenever it receives a signal, it only responds when that same number code is received.

Any player, when beginning play may enter his own name into the computer system along with the player's unit signal so that the computer system can display or print the player's name with his score. At the end of play the system will print a hard copy of the player's score on demand.

Since the scoring units are linked together some of the computer functions may be provided at a host computer to perform functions for display or printing at the simpler and less expensive remote scoring units which may be better positioned for receiving and transmitting over shorter distances to the player's units.

A registration station at the start of the course may be provided with means for receiving, by a keyboard for example, the name of the player, the number of his player's unit and some indication of relationship to certain other player's units such as a group playing together. In addition, the registration station may store a spoken name of the player along with the other information.

Each player's unit may be provided with audio radio receiving means. The player's unit may request the current scores for his group by signalling three times in quick succession. The scoring unit will convert the scores into audio and transmit them with appropriate names. The player's unit may be arranged to respond only to a particular code so that they are informed by name of each player in their group whenever a stroke is to be made. This system is considered most economical because it reduces the cost and complexity of the player's units which are most numerous. An audio radio employs inexpensive components, and decoding and on/off circuitry can be provided by inexpensive microprocessor circuitry in each player's unit. The player's unit in this simplest form of the system needs only a single actuator and is capable of transmitting a single code such as a string of short and long signals simular to Morse code whenever the actuator (such as a pushbutton) is actuated.

Analog to digital and digital to analog converters for converting audio into digital information for storage and manipulation and conversion back into audio for human perception are well known in the art and are readily available, inexpensive components for incorporation into the system.

Alternatively, the player's units may have visible displays for displaying information. The scoring units may be positioned at the tees or greenside and provided with large displays and printers and keyboards for communication.

These and other objects, features and advantages will become more apparent when the detailed description is studied in conjunction with the drawings, in which:

DETAILED DESCRIPTION OF PREFERRED EMBODIMENTS

Figure 1:
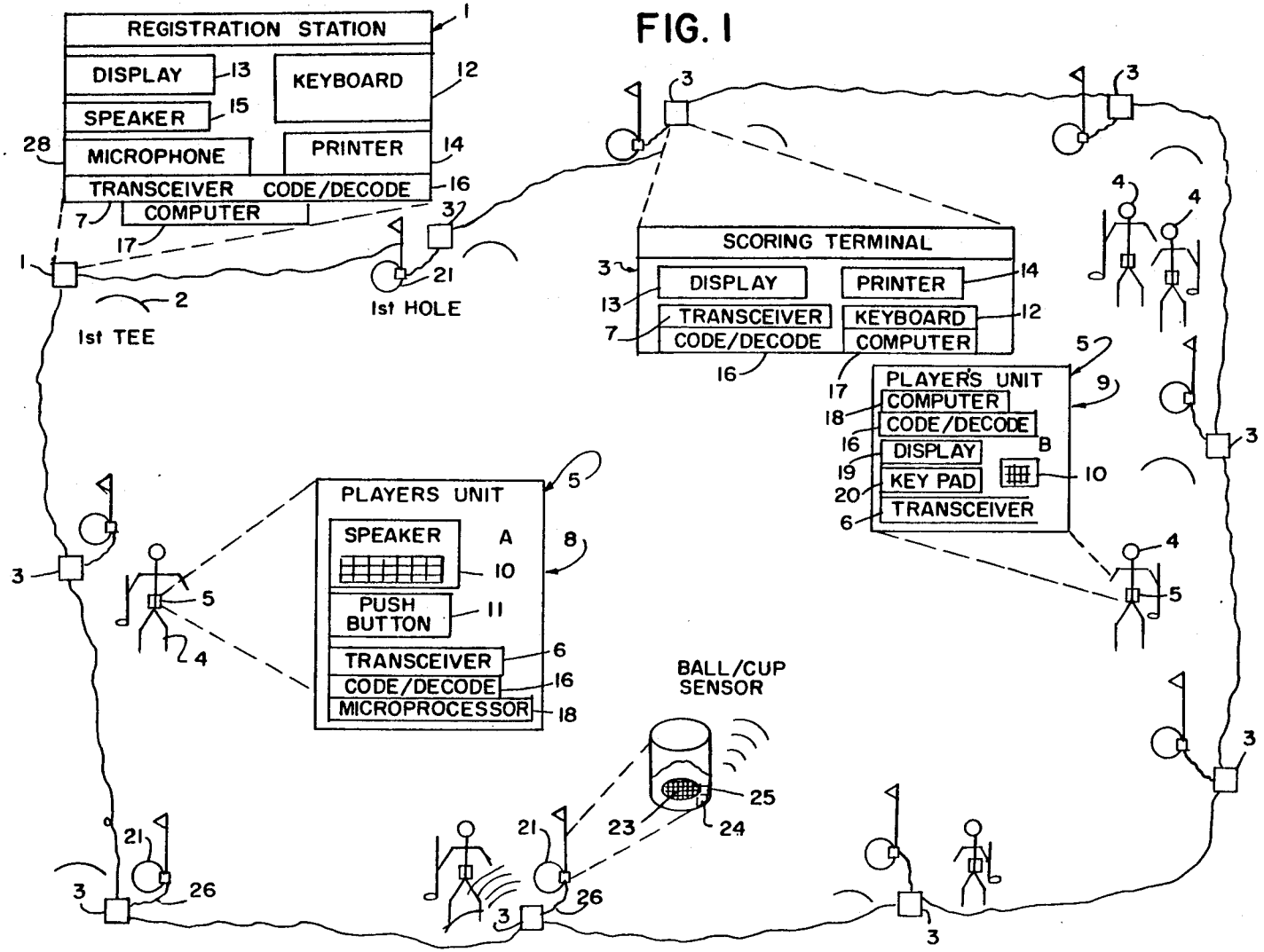
FIG. 1 is a diagrammatic representation of a nine hole golf course equipped with the invention.

Referring now first to FIG. 1, a nine hole golf course is illustrated diagrammatically with a set of computer operated elements connected together by wire in a network including a registration station 1 that will normally be located near the first tee 2, and a plurality of scoring terminals 3 that may be positioned near tees or greens or where readily accessed by spectators. The registration station and terminals may be connected by wire as shown or by wireless communication as desired. Each element of the network may be provided with full computer capabilities, or one may serve as a host computer with others having lesser capabilities and relying on the host for many functions. Each player 4 is provided with a player's unit 5 that fastens on a belt or is otherwise carried. The player's unit is in wireless communication with one or more of the scoring terminals or registration station by means of a transceiver 6 in the player's unit is and a transceiver 7 at every scoring terminal 3 and registration station 1. Two optional types of player's units are shown, the audio unit 8 and the video unit 9. The audio unit 8 is provided with a speaker 10 and a pushbutton electrical switch 11. The player communicates with the system by operating only the pushbutton 11. The system communicates with the player audibly through speaker 10. In addition, any player or spectator may communicate through a terminal by operating the keyboard. And the system may respond via display 13 or printer 14 or speaker 15 at the terminal.

The player with player's unit 8 will register at registration station 1 prior to play and after receiving a uniquely numbered player's unit. The player enters his name and the unit's number via the keyboard 12 and also speaks his name when requested. Each member of a team or foursome playing together registers together and indicates this to the registration station via the keyboard. All of the data are stored in the computer system. Also stored in the system are the unique codes corresponding to the number of the player's unit. The code received or transmitted may be in the form of a string of short and long bursts of transmission such as the Morse code representing the alphanumeric characters of the code. Whenever the pushbutton 11 is depressed, the transceiver 6 transmits a radio signal encoded with the unique code assigned to that particular player's unit. Any transceiver 7 in a player's terminal that receives the transmission decodes the transmission in the code/-decode unit 16. In the computer 17, it then adds one to the score accreditted to that number. It also looks up in a table to determine which player numbers are registered as part of the same team. It then transmits the number codes of all team members together with the audible name of the player whose transmission was just received. When the radio signal is received by all nearby player's units' transceivers 6, their microprocessors 18 decode the transmission and connect the speaker 10 to broadcast the audible name of the player if the code corresponds to the code of the particular player's unit.

When a player's pushbutton is depressed twice in succession, this signal at the computer system is taken as an indication that the player is about to play the next tee. That player's score for the previous hole is then totalled and a first stroke for the next hole is registered.

When a player's pushbutton is pressed three times in succession, the up-to-date scores of each player in the group are broadcast in audio to the enquiring player or to all members of the group as desired. The various scoring terminals or display terminals may be arranged to provide a real time display of all scores.

The video player's units 9 operate in much the same fashion except that the information is displayed visually on a display screen 19 and more information may be provided by input to keyboard 20 instead of the number of depressions of a single pushbutton.

Each hole 21 is optionally provided with a ball/cup sensor 22 which sends a signal to the computer system when a ball enters the cup. This may take many forms, such as the sensors described in U.S. Pat. No. 4,896,886 issued Jan. 30, 1990 to the Applicant and incorporated herein by reference.

Alternatively, the ball/cup sensor 22 as shown in FIG. 1 may be provided, including a rigid mesh plate 23 hingedly connected the side wall of the cup and resting upon a spring-loaded switch 24 that either operates a radio transmitter 25 or that is operatively connected to the computer system directly by wires 26 to scoring units 3. The operation of the ball/cup sensor mechanism 22 eliminates the need for the player's unit to signal the start of the next hole. In this case, two pushes on the pushbutton may indicate a request for updated score.

The embodiment that requires the least learning by the player employs a registration station that is operated by a course employee, such as when issuing player's units. The employee keys in the player's name as well as speaking it if an audio player's unit is used. The player presses a button before each stroke and the player's unit beeps and displays the name and score of the player on all the units of the foursome. If it is an audio unit it speaks the name and score.

A ball/cup sensor indicates to the system that the player who last pressed a button has completed the hole, and his total for the hole is computed. Enquiry of the scores of the team (group) may be displayed at a display at greenside or the next tee. With this system, both video and audio player's units need only a single pushbutton to communicate with the rest of the system and no special systems need be learned by the player. Means may be provided for the player's unit to transmit the number of the next hole to be played. Another button, labelled "score" may be provided for displaying or speaking the current scores of the team members. This feature may not be very useful, since the current score of each player is spoken or displayed each time he prepares for a stroke by pressing a button or key. The player hears a beep before a member of the team hits the ball. He looks at the display and sees "Palmer 42". He hears another beep and sees "Balasteros 44". He hears another beep and sees "Colley 39". Now it is his turn to key his player's unit and address the ball. With this kind of running score, there is not a great need for additional interrogation, and an occasional glance at one of the display terminals provided conviently along the course will keep tabs on the rest of the competition in a tournament. The optional audio player's unit operates in much the same fashion except that the names and scores are broadcast from the speaker 10 on each player's unit.

FIGS. 2-5 provide more details of the structures of the individual components which make up the golf scoring system of the invention.

Figure 2:
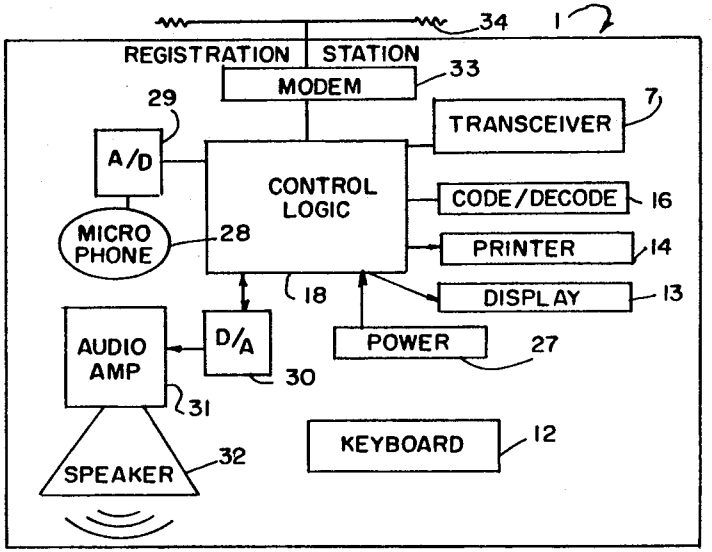
FIG. 2 is a block diagram of a registration station.

FIG. 2 shows a registration station 1 with an electric power supply 27 that may be line source or battery, a control logic element 18 such as a computer or microprocessor with memory, controlling an optional printer 14; a display 13; a transceiver 7 for two-way radio communication with the players units; a code/decode module 16 for conversion between code signals to and from the player's units to computer information signals to and from the control logic; a keyboard for data entry; and, optionally, a microphone 28 with analog to digital converter for converting voice signals into computer information signals for storage and processing; and a digital to analog converter 30 for converting digital computer signals into audible sound through an audio amplifier 31 and a loudspeaker 32. The station is provided with a modem 33 to communicate by wires 34 with the scoring terminals.

Figure 3:
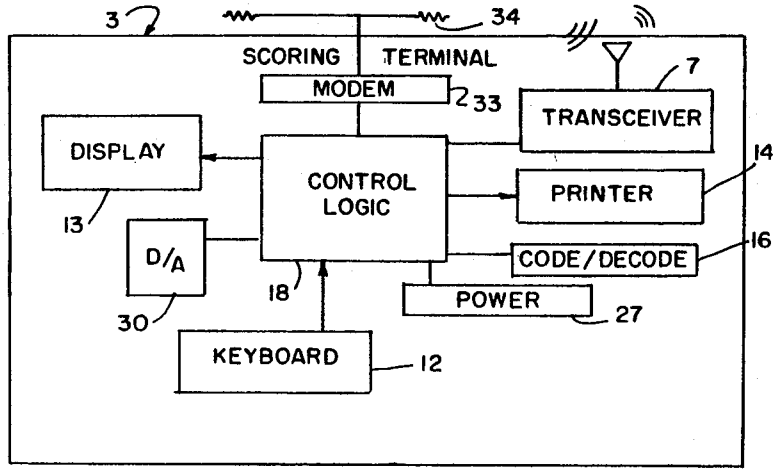
FIG. 3 is a block diagram of a scoring terminal.

FIG. 3 shows a scoring terminal with a control logic or computer 18 connected to power supply 27; printer 14; display 13, code/decode module 16, keyboard 12, and modem 33 for communication with other terminals and the registration station by wires 34. It communicates by transceiver 7 with the player's units with 2-way radio signals. It may optionally be provided with a keyboard for data entry or enquiry and a digital to analog converter 30 for modulating the radio broadcast with audio such as player's name and score. The code/-decode module provides for encoding broadcast data so that it will be accepted only by particular player's units and it identifies received broadcasts by player's unit so as to credit scores appropriately.

Figure 4:
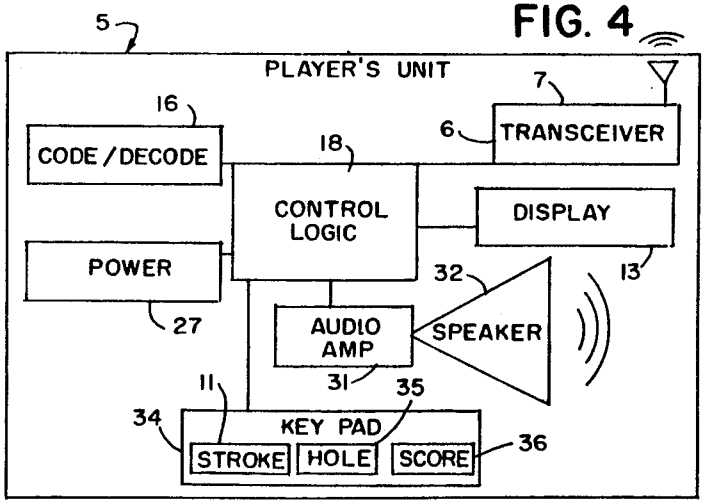
FIG. 4 is a block diagram of a player's unit.

FIG. 4 shows a player's unit with a control logic 18 that may be a microprocessor or computer connected to a battery power 27, a transceiver 6, keypad 34 with one or more keys. A first key 11 is actuated before each stroke is made. A second key 35 may be provided for actuation before teeing off at a next hole. A third key 36 may be provided for requesting scoring information. A code/decode module 16 in the logic transforms signals between the radio broadcast signals and computer recognizable signals identifying particular player's units. The unit is provided with an audio amplifier and speaker for audible signals which may be simple beeps or intelligible voice information in the audio option. Alternatively, the liquid crystal display 19 may be provided for the video option. The keypad may contain numerical keys to enter the number of the next hole intended to be played.

Figure 5:
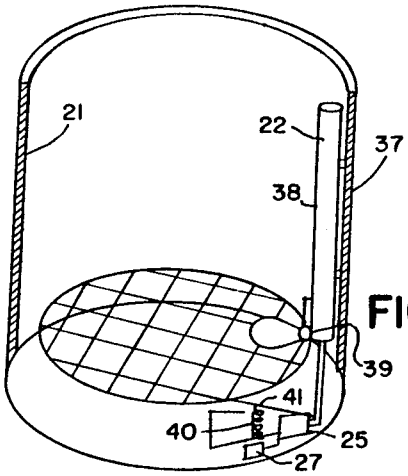
FIG. 5 is a diagrammatic representation of a ball/cup sensor of the invention.

FIG. 5 is partially broken away view of a cup showing a representative ball/cup sensor 22 for communicating to the system that a ball has fallen in. Attached to the side wall 37 of cup 21 is a post 38. Hinge 39 connects a rigid mesh plate 23 to post 38. Spring 40 holds plate 23 up and switch 41 open until a ball pushes plate 23 down and closes switch 41. Power supply 27 provides power to radio transmitter 25 whenever the switch closes. This radio signal is received by the system to indicate that the last stroke recorded has resulted in sinking the ball in a particular hole. The radio transmitter may be replaced by direct wiring to the system as desired. The ball/cup sensor 22 may take many forms as described in U.S. Pat. No. 4,896,886 issued to the applicant.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A system for generating, storing and retrieving golf scoring data in real time for a plurality of players playing in groups or teams on a golf course having holes or cups, said system comprising:

A) a plurality of computer-controlled terminals distributed about said course so that any point on said course is close to at least one said terminal, each said terminal including, 1) a terminal transceiver means for wireless transmission and receipt of golf scoring data, 2) display means for visible display of golf scoring data, and 3) connecting means operatively connecting all said terminals together in a network for transmitting, receiving and real time sharing of golf scoring data therebetween;

B) a plurality of computer-controlled, portable player's units for assignment to individual players to carry about the course for wireless communication of golf scoring data with said terminals, each said player's unit including, 1) a player's transceiver means for wireless transmission and receipt of golf scoring data in cooperation with said terminal transceiver means, 2) a manually-operable input means for inputting golf scoring data into said system, 3) signalling means for producing sounds audible to a player carrying a unit, said sounds conveying only information related to golf scoring information relevant to said player carrying said unit, 4) computer means for controlling operation of said unit, and 5) portable electric power means for providing power for operation of said unit;

C) player's unit encoding means for providing a unique, wireless-transmissible code for each said player's unit which identifies a particular player's unit when transmitting golf scoring information between any two transceiver means;

D) each said player's unit being provided with coding means for coding wireless transmissions with only a unique code assigned to that particular player's unit and no other code to enable said system to verify the identity of a data entry;

E) each said player's unit being provided with decoding means for decoding received wireless transmissions and operating said signalling means only when the unique code assigned to the particular player's unit is received; and F) said network being provided with coding and decoding means for identifying the source of a transmission received and for directing a transmission to a particular player's unit.

2. The system according to claim 1, in which said wireless transmission is radio waves.

3. The system according to claim 2, in which said signalling means includes a visible display.

4. The system according to claim 2, in which said terminals include hard copy printers.

5. The system according to claim 2, in which said radio waves are modulated with audio frequency information.

6. The system according to claim 5, in which said manually-operable input means is limited to a single key means for input of information into the system for simplicity of operation, operation of said key means transmitting a coded signal from the player's unit to said coding and decoding means in said network.

7. The system according to claim 6, in which receipt of a single coded signal from a single operation of said single key means causes said system to add one stroke to the score of the player assigned to the player's unit which transmitted said coded signal, and to transmit a verifying signal to all of the player's units of players in the group or team associated with the the player whose unit has transmitted said coded signal.

8. The system according to claim 7, in which said verifying signal includes the identity of the player and the player's score.

9. The system according to claim 2 further comprising cup means for indicating to said network that a ball has entered a hole or cup.

10. The system according to claim 9, in which said cup means is a sensor operatively connected to said network.

11. The system according to claim 9, in which said cup means is enabled by operation of said input means by a player.

12. The system according to claim 2, in which receipt of a coded signal from operation of said input means causes said system to add one stroke to the score of the player assigned to the player's unit which transmitted said coded signal, and to transmit a verifying signal to all of the player's units of players in the group or team associated with the player whose unit has transmitted said coded signal.

13. The system according to claim 12, in which said verifying signal includes the identity of the player and the player's score.

* * * * *